United States Patent [19]

Barr

[11] 4,326,704

[45] Apr. 27, 1982

[54] TIPPING MACHINE

[75] Inventor: William H. Barr, Hingham, Mass.

[73] Assignee: Universal Tipping Company Incorporated, Hanover, Mass.

[21] Appl. No.: 48,149

[22] Filed: Jun. 13, 1979

[51] Int. Cl.[3] ..... B65H 39/02

[52] U.S. Cl. ..... 270/58; 156/552; 156/241

[58] Field of Search ..... 270/58, 52, 51, 43, 270/32; 271/33, 271; 156/552, 566, 570, 578, 364, DIG. 1, DIG. 2, DIG. 20, DIG. 24, DIG. 28, DIG. 34, DIG. 37, 230, 238, 241

[56] References Cited

U.S. PATENT DOCUMENTS

| | | | |
|---|---|---|---|
| 1,652,697 | 12/1927 | Boettger | 156/DIG. 2 |
| 2,378,112 | 6/1945 | Tuthill et al. | 156/552 |
| 2,736,448 | 2/1956 | Winn | 156/DIG. 2 |
| 3,039,516 | 6/1962 | Vinal | 156/DIG. 2 |
| 3,400,031 | 9/1968 | Crathern | 156/364 |
| 3,448,979 | 6/1969 | Farmer | 271/33 |
| 3,484,097 | 12/1969 | Jory | 270/52 |
| 3,508,995 | 4/1970 | Thompson | 156/552 X |
| 3,758,367 | 9/1973 | Berg | 156/552 X |
| 3,886,026 | 5/1975 | Kienel | 156/566 X |
| 4,113,538 | 9/1978 | Green | 156/DIG. 20 |

FOREIGN PATENT DOCUMENTS

| | | | |
|---|---|---|---|
| 1486988 | 6/1969 | Fed. Rep. of Germany | 156/552 |
| 387580 | 9/1933 | United Kingdom | 156/DIG. 2 |
| 1002932 | 9/1965 | United Kingdom | 156/DIG. 20 |
| 206370 | 1/1968 | U.S.S.R. | 156/552 |

*Primary Examiner*—E. H. Eickholt
*Attorney, Agent, or Firm*—Robert E. Ross

[57] ABSTRACT

A tipping machine of the type in which articles, such as credit cards, identification cards or the like, are secured by adhesive to a continuous sheet at predetermined spaced intervals on the sheet. A feeder initially positions the articles on the moving sheet at or slightly behind the desired position, and a pusher mechanism is provided behind the card to accelerate to a speed greater than the speed of the moving web, contact the rear edge of the card, and align it to a desired orientation, and, if necessary, push it forwardly on the sheet to the desired position.

The pusher operates in timed relation to the feeding mechanism and in relation to position of the spaced areas thereon intended to receive the articles, so that the pusher speed reaches the speed of the moving web simultaneously with the arrival of the forward end of the pusher at the position on the sheet at which the trailing edge of the article is to be positioned.

7 Claims, 6 Drawing Figures

TIPPING MACHINE

BACKGROUND OF THE INVENTION

In the printing and advertising business, it is often desired to attach an article, such as a credit card, or identification card or the like onto a printed form or advertising sheet in a predetermined position. Such sheets or forms are often printed consecutively on a continuous web of material, to be separated later at transverse perforations. Hence the articles must be secured at predetermined spaced positions on the continuous sheet.

For greatest speed in accomplishing this assembly, it is desirable that the web of material move continuously through the machine with the articles being fed onto the desired position on the moving sheet.

However, it has been found difficult, for a number of reasons, to provide a feeder that will accurately position the articles onto a moving web of material.

A machine with acceptable versatility, that will be able to process forms of various lengths, means must be provided for changing the distance between the applied articles, to conform to the length of the printed form.

For example, if the machine is set up to operate on forms having a length of 3½ inches, the feeder will be operated at a rate such that it will feed a card at intervals corresponding to a movement of the continuous sheet of 3½ inches. The feeder is provided with means for accelerating the card to the speed of the moving sheet.

However, if a form having a length of 4 inches is to be processed by the machine, the speed of the web must be increased so that a card is placed on the moving web every 4 inches. However, this means that the card does not attain the speed of the belt, and therefore arrives at a position on the printed form slightly behind the desired position.

Another problem encountered in the feeding of cards onto the moving printed forms is that often one end side edge of the card will contact the moving web before the other, causing the card to be positioned on the form at a slight angle to the desired orientation. This problem is made worse by the presence of the glue which is applied to the form prior to the positioning of the card therein.

SUMMARY OF THE INVENTION

The invention disclosed herein provides a tipping machine of the type described above, in which a reciprocating pusher is provided which operates in timed relation to the feeding mechanism and in relation to the predetermined position of the spaced areas on the moving sheet intended to receive the articles.

The pusher operating mechanism causes the pusher to accellerate forwardly in relation to the moving sheet until the speed of the pusher reaches the speed of the sheet, and then slows and retracts until it is rearwardly of the ne t article receiving position, at which time it starts forwardly again. The motion of the pusher is so timed that the pusher matches the speed of the sheet when the extreme ends of the pusher arrive at the rear edge of the predetermined position.

Therefore, on the forward travel of the pusher, if the article is behind its intended position, the pusher catches up with the article and pushes it forwardly on the sheet to its proper position.

When feeding flat rectangular cards or the like, which should be positioned with their top and bottom edges perpendicular to the motion of travel of the sheet, the pusher may be provided with at least a pair of spaced pusher portions which, in contacting the card at laterally spaced positions, will properly orient the card as it is being pushed forwardly.

The pusher operates in timed relation to the feeding mechanism and it is provided with means for adjusting the length of forward travel of the pusher.

The feeder mechanism is so accurate in positioning the articles that even in operations in which the speed of the card, in arriving on the moving sheet, is the same as that of the moving sheet, it may be desirable to intentionally position the article slightly behind the proper position, since the pusher can provide subsequent, more accurate positioning.

DESCRIPTION OF THE ILLUSTRATED EMBODIMENT

Figure 1:
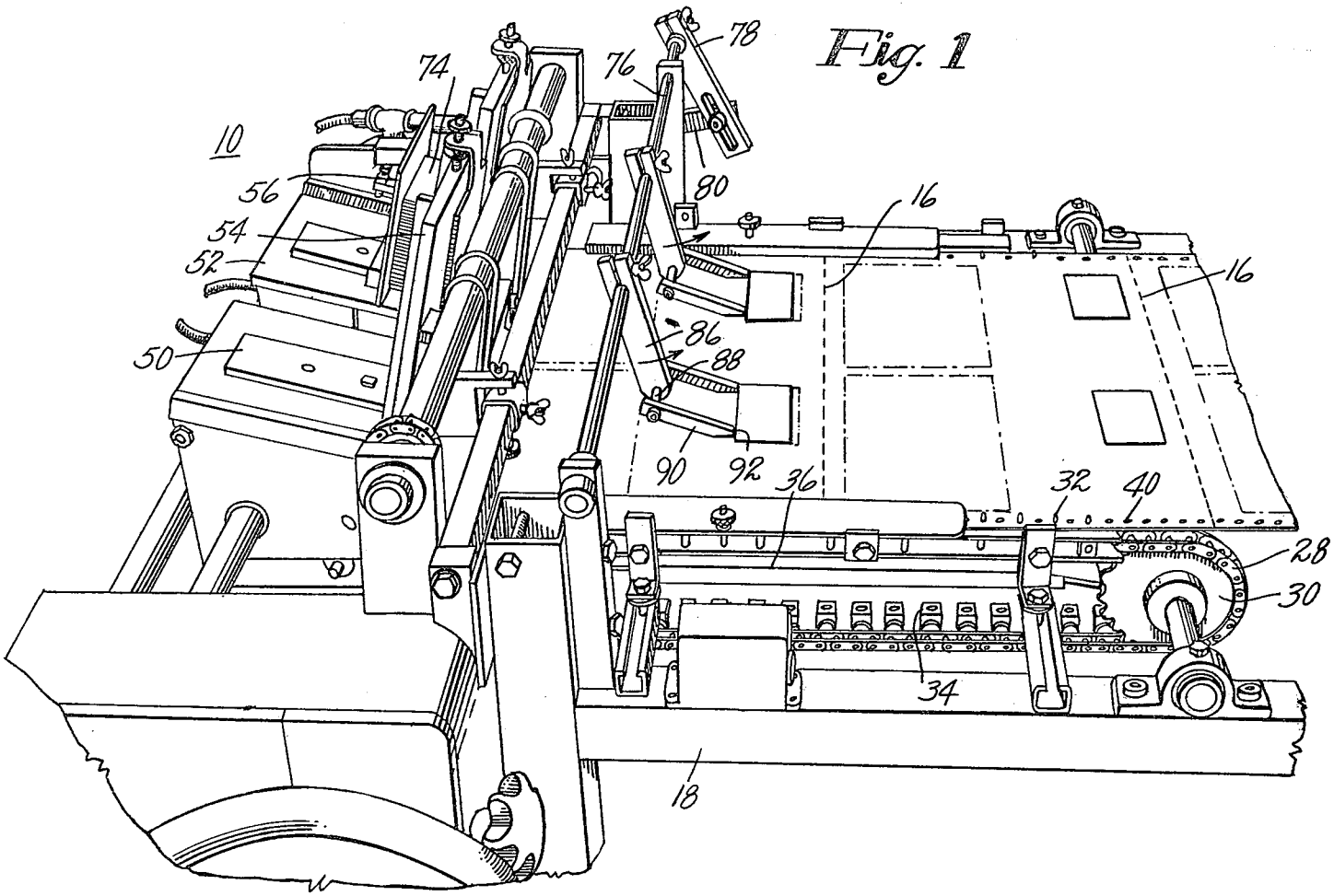
FIG. 1 is a view from one side and above a tipping machine embodying the features of the invention, with the feeding end at the left and the discharge end at the right.

Referring to the drawing, there is illustrated a machine 10, which applies an article such as a card 12 to a moving web 14 separable into individual printed forms at transverse perforations 16.

The machine 10 comprises a main frame 18 having a horizontal bed with web feeding means 20 at one end and web take-up means (not shown) at the other end. The web feeding means 20 comprises a main drive roll 24, driven at a constant speed through suitable gearing and drive motor (not shown). The main drive roll 24 carries a sprocket 26 which drives a chain 28 which extends between the roll 24 and an idler roll 30 near the opposite end of the bed 20.

The chain 28 carries a series of pins 32 suitably mounted in carriers 34 so that they are movable by gravity axially between an extended and a retracted position. On the lower run of the chain, the pins drop to the extended position; however, on arrival at the upper side of the drive sprocket 26 they drop to the retracted position. A support 36 suitably positioned beneath the upper run of the chain with a cam surface 38 lifts the pins on the upper run so they project through drive perforations 40 along the edges of the web. The support 36 terminates in front of the idler sprocket so that the pins can drop out of the web perforations before the pins are carried around the idler sprocket.

During operation of the machine, the web 14 travels over the main drive roller along the upper surface of the bed and then between suitable rollers for pressing the cards onto the sheet, and then onto a discharge pile (not shown) at a constant predetermined rate of speed. To secure the cards to the individual forms, adhesive is applied to a predetermined area on each form by means of an adhesive-applying roller 42 having protruberances 44. The roller is rotated in timed relation to the motion of the web, so that the protuberances first contact an adhesive-coated drum 46 rotating in a bath 48 of adhesive and then contact the predetermined area of the web which is to receive the card 12.

The cards 12 are fed onto the sheet by suitable feed means comprising a feeder plate 50 which oscillates forwardly and rearwardly on a support plate 52 in timed relation to the movement of the web.

Guide plates 54 and 56 are provided above the feeder plate for holding a stack of cards to be fed.

A separator plate 58 projects downwardly from the lower edge of the forward guide plate 54, with the bottom edge of the separator plate being spaced from the support plate a distance slightly greater than the thickness of one card.

The feeder plate 50 is provided with air holes 60 connected to a suitable vacuum source, and an abutment 62 positioned to encounter the rear edge of a card when the feeder plate moves forwardly.

Positioned at the forward end of the support plate are lower feed rollers 64, and carried by the forward guide plate 54 is a feed belt assembly comprising a vertically adjustable guide block 66 carrying a pair of upper feed rollers 68. The rollers of each pair are spaced apart axially of the direction of motion of the cards therethrough, and a line drawn between the rollers of each pair extends downwardly toward the web 14.

A driven shaft 70 is disposed above the guide block, and a pair of feed belts 72 extend around the shaft 70 and the feed rollers 68.

In operation, the bottom card of a stack 74 of cards is pushed forwardly by the feed plate 50 so that it is received between the lower feed rollers 64 and the portion of the feed belts 72 passing under and around the upper rollers 68, which then carry the card forwardly onto moving web 14.

As previously stated, if the machine is to process webs consisting of forms of only one length (for example, $3\frac{1}{2}$ inches), the cards can be accurately positioned on the moving web by actuating the feeder plate 52 in timed relation to the movement of the web.

However, if a web is to be processed which is composed of forms having a slightly greater length (for example, 4 inches), the cycle rate of the feeder must be reduced by a corresponding percentage in relation to the speed of the web. This may most conveniently be accomplished by increasing the speed of the web while maintaining the same feeder cycle rate.

As a result, the forward speed of the card is less than the speed of the web, and the card arrives on the web slightly behind its intended position.

It would be possible to drive the feed belts 74 directly from the mechanism driving the web, so that changes in the cycle rate of the feeder would not affect the speed of the feed belts, which would therefore always run at the same speed as the web.

However, the feed belts would therefore be running at a speed greater than the forward speed of the feed plate and the card when the card is pushed between the feed belts and the lower feed rollers 64. This would require that the card be accelerated in passing from the feed plate to the feed belts. However, it has been found impossible to position the feed belts so accurately that the card is contacted by both belts simultaneously, and therefore one belt accelerates one end of the card a moment before the other belt accelerates the other end, and therefore the card arrives on the belt in a canted position.

This result can also occur even if the plate and the feed belts are moving at the same speed.

Therefore, to provide means for accurately positioning the cards in the desired area and in the proper orientation, a card positioning mechanism is provided to move the cards into the desired position after they have been placed on the web by the feed mechanism.

Said mechanism comprises an oscillating drive rod 76, driven by a crank arm 78 from a connecting web 86 from a crank arm 82 disposed on a driven shaft 84.

Secured to the rod 76 is an arm 86 carrying on the remote end a pusher assembly comprising a transverse rod 88 carrying a pair of pushers 90 which extend forwardly and downwardly to rest on the surface of the web. The ends of the pushers have vertical end portions 92 to engage the cards as will appear hereinafter.

The pushers are pivotally mounted so that the distal ends thereof rest in the illustrated embodiment, by gravity on the surface of the web, although the pushers could be spring biased downwardly if desired.

Figure 2:
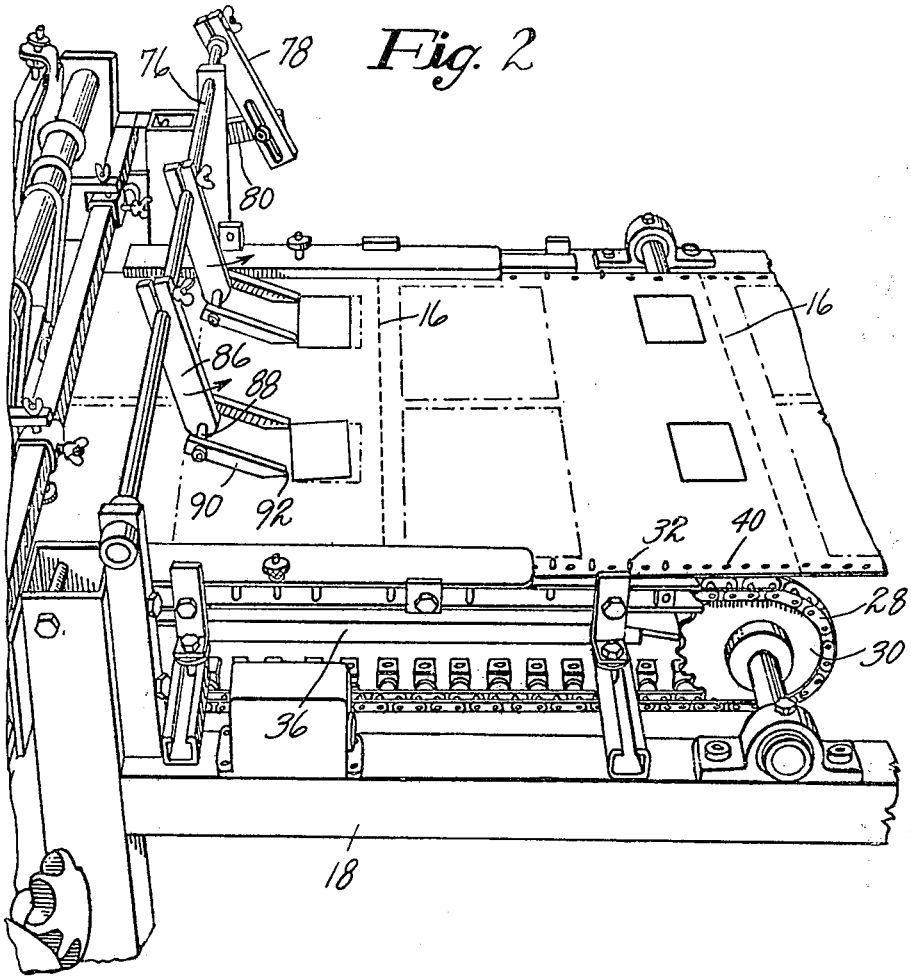
FIG. 2 is a view of the machine of FIG. 1 as seen from the feeding end.
Figure 3:
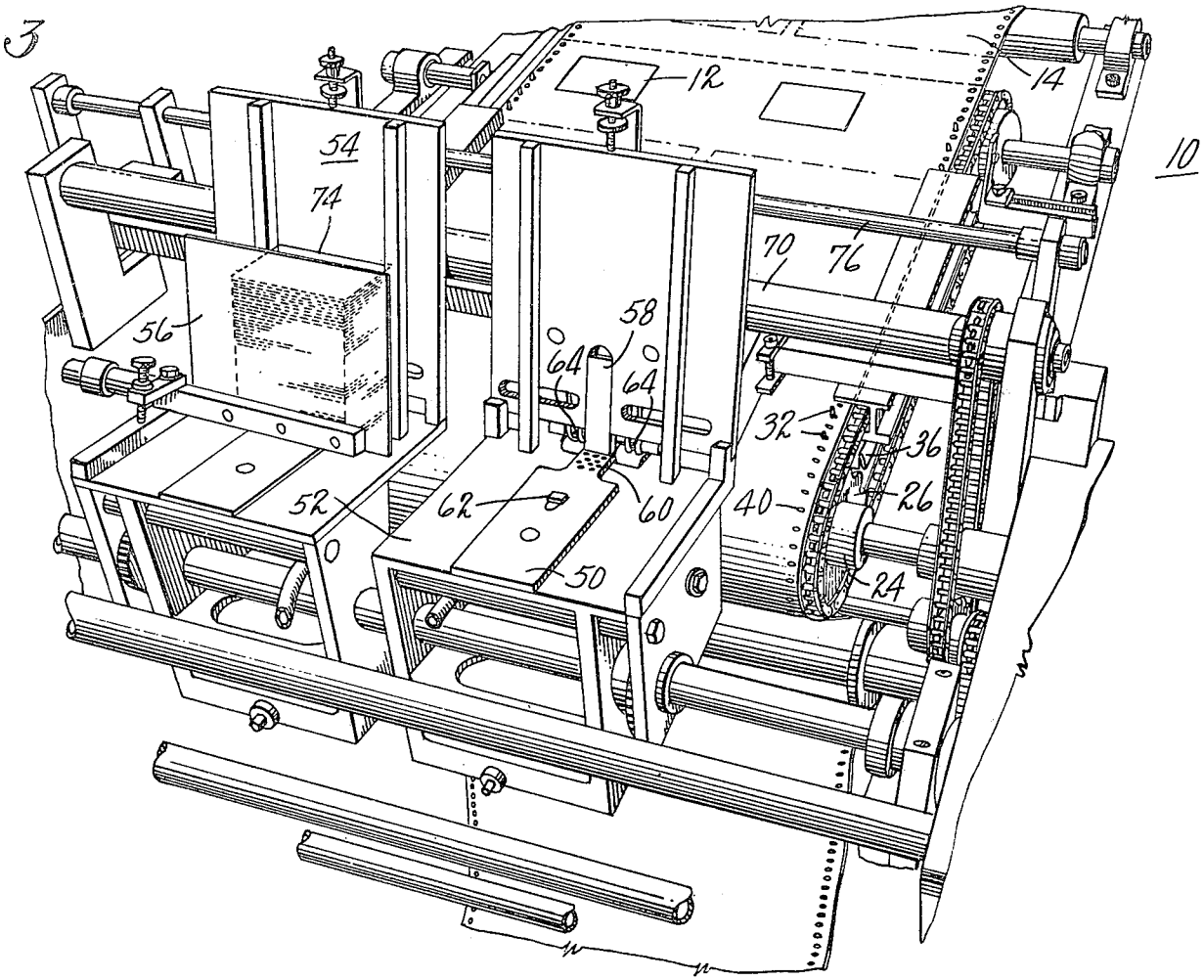
FIG. 3 is a perspective view of portions of the machine mechanism as seen from the feeding end, with portions of the machine omitted for clarity.
Figure 4:
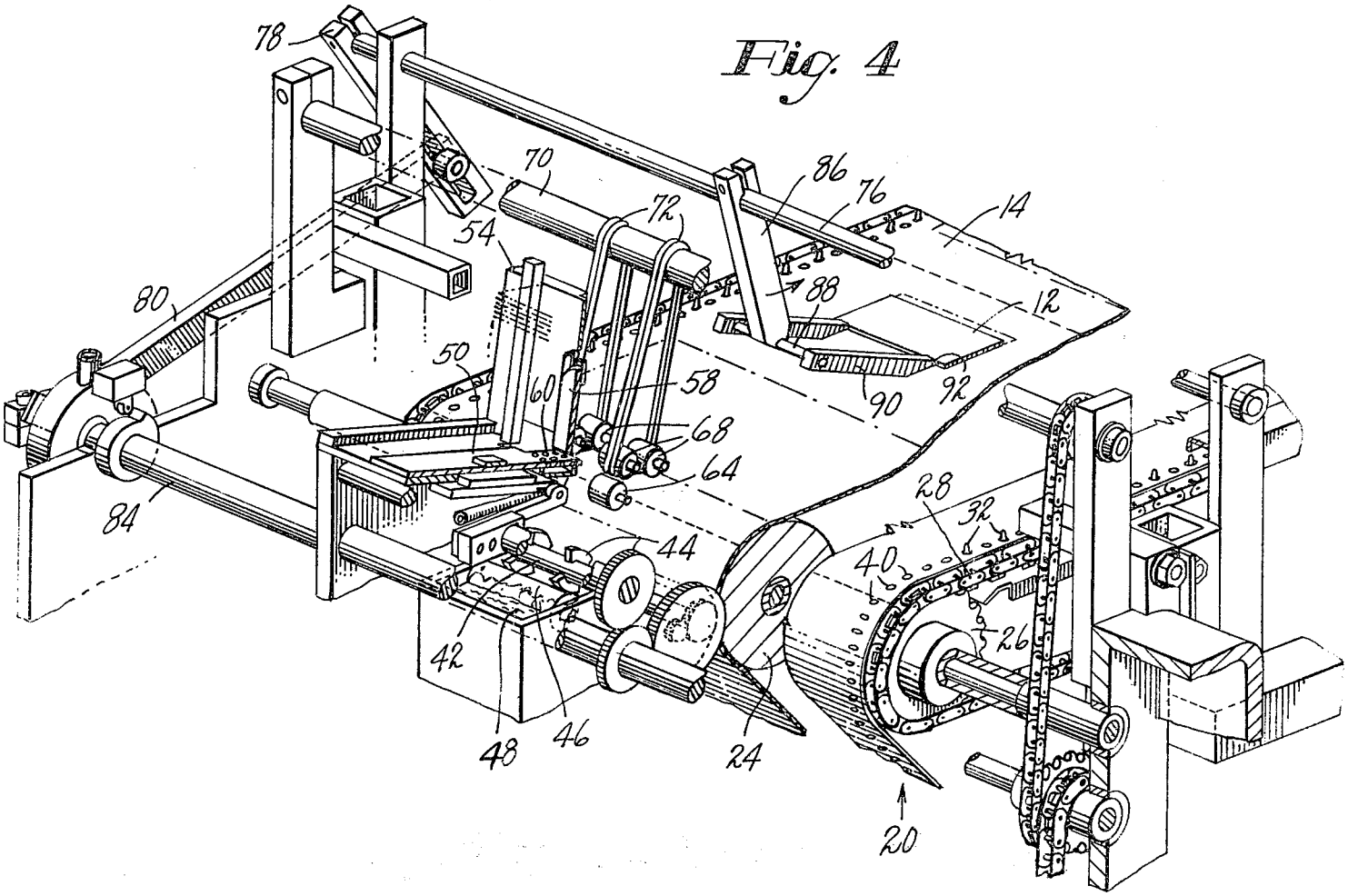
FIG. 4 is view in side elevation partly in section, of the card feeding mechanism as seen from the right side of the machine.
Figure 5:
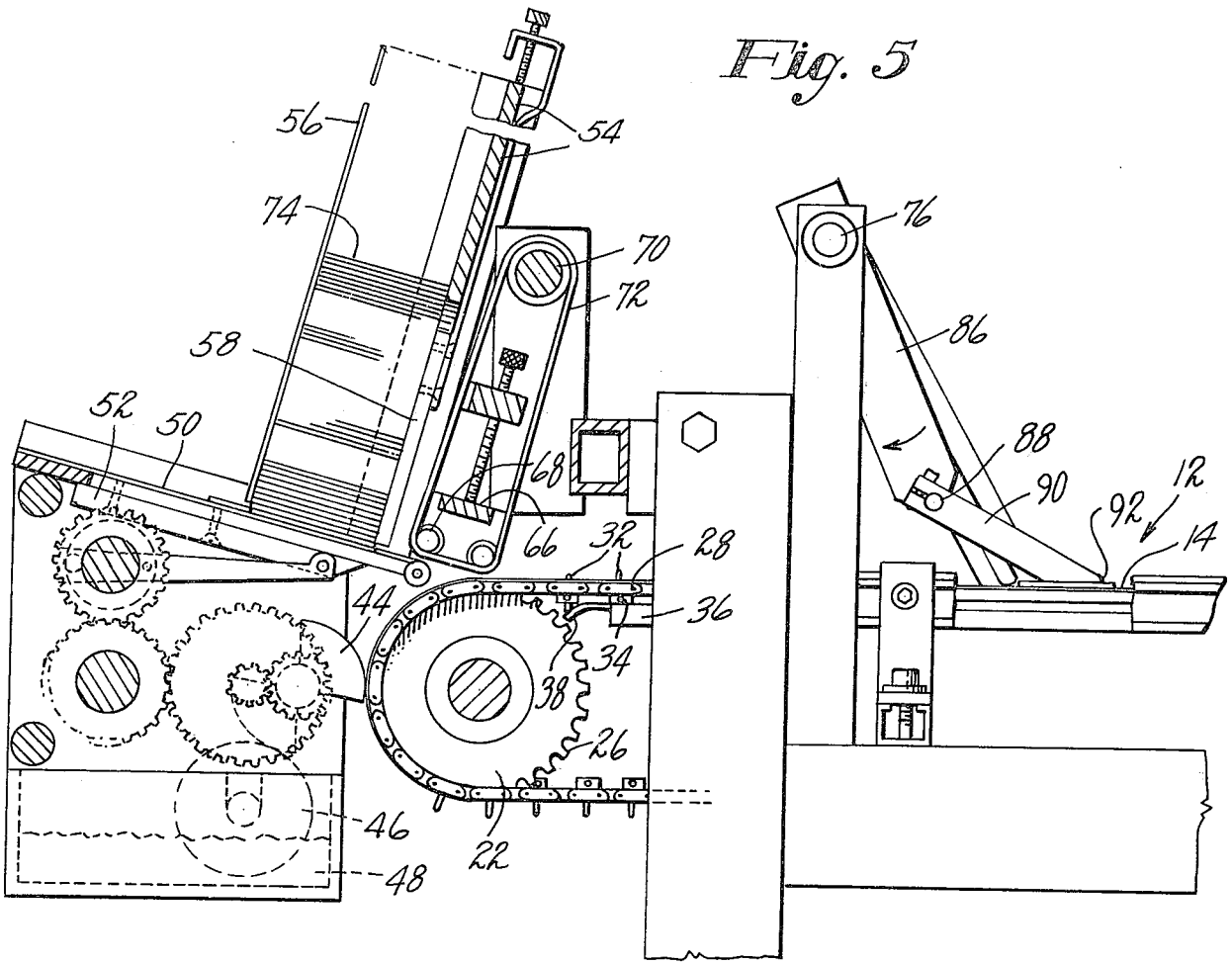
FIG. 5 is a side view of the card feeding mechanism as seen from the right side.
Figure 6:
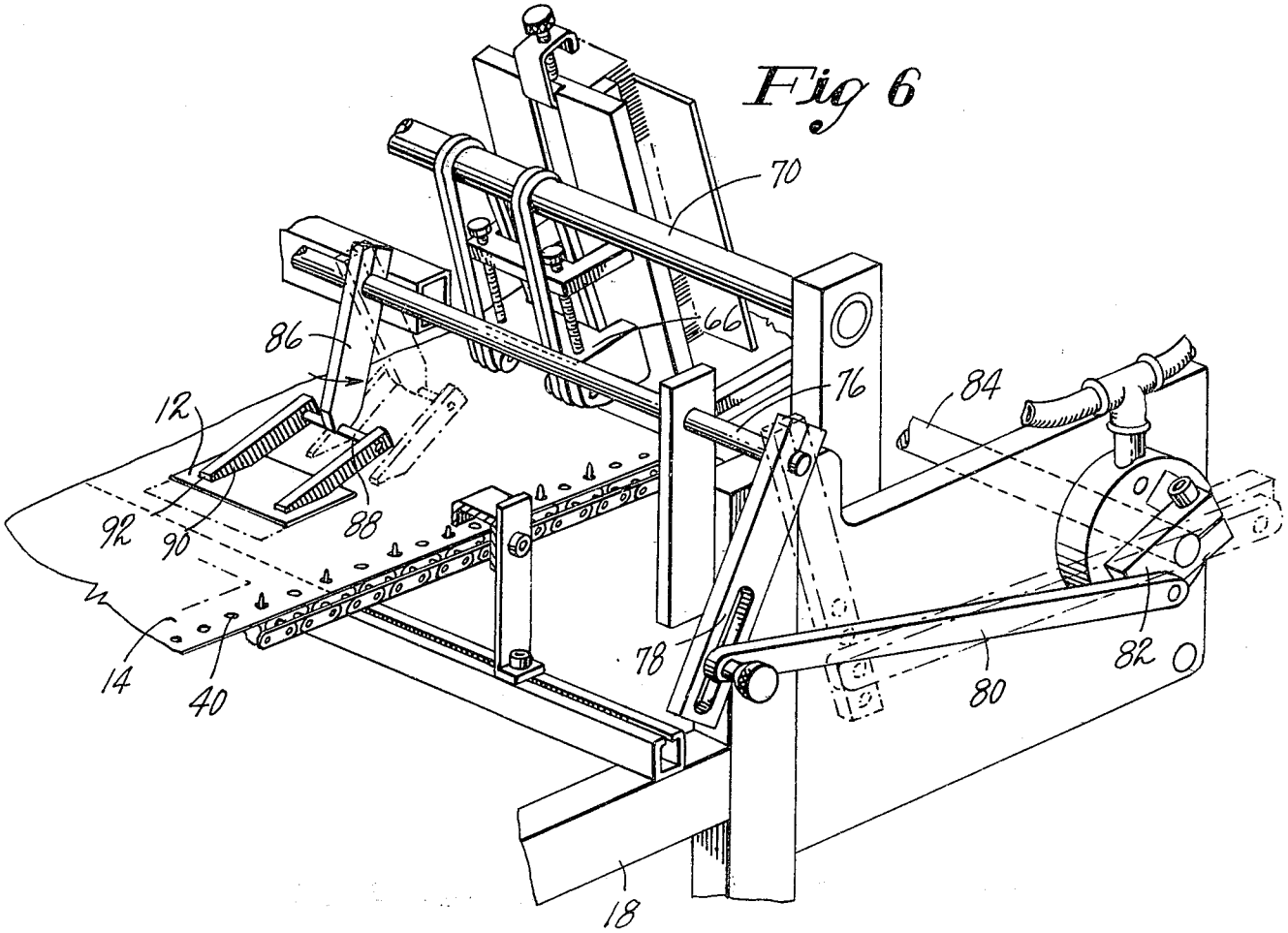
FIG. 6 is a perspective view of the pusher mechanism as seen from left side of the machine.

The rod 76 is caused to oscillate in timed relation to the operation of the feeder mechanism, so that after a card has been placed on the web by the feeder it passes forwardly under the pushers (which are retracting from the previous cycle, see FIG. 5), after which the pushers accellerate forwardly toward the card reaching a speed greater than the speed of the web (see FIG. 1), catch up with the trailing edge of the card, push it to the desired position, decellerate, and then retract. The movement of the pushers is so timed that the speed of the pusher just matches the speed of the moving web when the ends of the pushers reach the desired position of the rear edge of the card (FIG. 2).

Cards that are behind the desired position will therefore be pushed forward to the desired position, and cards that are canted in relation to the axis of the web will be properly oriented.

The pushers then retract, passing over the next card that has been applied to the web, stopping just rearwardly of said next card, and then again starts its forward motion to catch up with and position said next card.

The shaft 84, which drives the connecting rod 80, is driven in timed relation to the operation of the feed plate 50.

In the processing of forms in which a card is to be applied, for example, every $3\frac{1}{2}$ inches, the feeder will be actuated, by suitable gearing not shown, for every $3\frac{1}{2}$ inches of travel of the web, and the speed of the feed rollers and feed belt can be made to match the speed of the moving web, so that the card can be fairly accurately placed on the proper area of the form (although orientation may still be necessary).

However, if the forms are larger, so that a card is to be applied, for example every 4 inches, the web speed will be increased. The speed of the card, in arriving on the web, must therefore be increased by contact with the web, which can cause slippage of the card in relation to the web. However, the pusher will nevertheless contact the card and push it forwardly into the proper position.

Although the illustrated embodiment of the device is designed to apply cards to a moving web, the principles of the invention may be applied to machinery for the positioning and assembly of other articles. Other fastening means than an adhesive may be used, to suit the particular type of assembly.

Since certain other obvious changes may be made in the device without departing from the scope of the invention, it is intended that all matter contained herein be interpreted in an illustrative and not a limiting sense.

We claim:

1. A tipping machine for placing articles onto a series of predetermined positions on a moving support comprising a feeder mechanism for placing articles on said support slightly behind the predetermined positions, and position adjustment means for thereafter contacting each article and pushing it forwardly on the moving support to the predetermined position, in which said feeder mechanism accelerates each article to the approximate speed of the moving support before placing said article on the support.

2. A tipping machine for placing articles onto a series of predetermined positions on a moving support comprising a feeder mechanism for placing articles on said moving support slightly behind the predetermined positions, and position adjustment means for thereafter contacting each article and pushing it forwardly on the moving support to the predetermined position, in which said machine includes means for applying an adhesive to said predetermined area on the moving support, and said position adjustment means operates to push the article forwardly on the moving support before the adhesive has set.

3. A machine for assembling a series of flat articles such as cards onto predetermined longitudinally spaced positions on a moving web, comprising means for moving said web at a constant speed, means for applying an adhesive to said predetermined positions on said web, feeder means for placing articles onto said web at or slightly behind said predetermined position, and a pusher operating in timed relation to the motion of the web, means oscillating said pusher forwardly and backwardly in relation to the axis of motion of the web, so that on its forward motion the pusher accelerates to exceed the forward speed of the web and then slows to less than the forward speed of the web, said pusher motion being timed and positioned by said means so as to reach the forward speed of the web when the foremost end of the pusher reaches the rear edge of said predetermined position, whereby if the rear edge of the article is behind said rear edge of the predetermined position, the article is pushed forwardly by the pusher to the predetermined position.

4. A machine as set out in claim 3 in which said pusher has at least two laterally spaced pusher elements, the foremost ends thereof being so positioned and dimensioned that each arrives at the rear edge of said predetermined position when the forward speed of the pusher equals the forward speed of the web thereby if an article is behind the predetermined position, the pusher elements will push it forwardly on the web to the predetermined position and said spaced pusher elements will orient said article, if necessary, to the orientation determined by the position of the foremost ends of the pusher element.

5. A machine as set out in claim 3 in which said means oscillating said pusher includes an arm which oscillates forwardly and backwardly, said pusher being mounted on the arm, the forward end of said pusher resting by gravity on the web, and being so positioned over the web downstream of the feeder means that on its rearward movement it passes over an article which is moving forwardly with the web, and on its forward movement it catches up with said article if said article is behind the predetermined position for said article and pushes it forwardly on the web to said predetermined position.

6. A method of mounting individual articles onto predetermined positions on a continuous support at longitudinally spaced intervals, comprising the steps of moving the support longitudinally at a constant rate, feeding the articles onto said support, each to position such that the rear edge of the article is only slightly behind the rear edge of one of said predetermined positions, and subsequently pushing each article forwardly so that the rear edge of the article is aligned with the rear edge of said predetermined position.

7. A method as set out in claim 6 in which an adhesive is applied to the predetermined positions prior to the feeding of the article onto the support, and the articles are pushed forwardly before said adhesive has set, and thereafter allowing said adhesive to set.

* * * * *